US005190717A

United States Patent [19]

Bayliss

[11] Patent Number: 5,190,717

[45] Date of Patent: Mar. 2, 1993

[54] METAL POURING SYSTEM

[75] Inventor: Colin R. Bayliss, Rugby, England

[73] Assignee: T&N Technology Limited, Rugby, England

[21] Appl. No.: 765,319

[22] Filed: Sep. 25, 1991

Related U.S. Application Data

[62] Division of Ser. No. 527,309, May 23, 1990.

[30] Foreign Application Priority Data

May 25, 1990 [GB] United Kingdom ..... 8912081

[51] Int. Cl.[5] ..... B22D 41/00

[52] U.S. Cl. ..... 266/80; 266/94; 222/590

[58] Field of Search ..... 266/94, 44, 45, 80; 222/590; 164/452, 453, 155

[56] References Cited

U.S. PATENT DOCUMENTS 3,921,697 11/1975 Petry ..... 164/453
4,592,410 6/1986 Takamoto et al. ..... 164/453
4,600,047 7/1986 Matoba et al. ..... 164/452

FOREIGN PATENT DOCUMENTS 3532763 3/1986 Fed. Rep. of Germany .

OTHER PUBLICATIONS

Patent Abstracts of Japan, vol. 12, No. 495(M-780) (3342), 23 Dec. 1988; & JP-A-63215357 (Mitsuieng) Sep. 7, 1988.

Patent Abstracts of Japan, vol. 8, No. 158(M-311) (1595), 21 Jul. 1984; & JP-A-5954456 (Shin Nippon) Mar. 29, 1984.

Patent Abstracts of Japan, vol. 10, No. 333(M-534) (2389), 12 Nov. 1986; & JP-A-61137658 (Kawasaki) Jun. 25, 1986.

*Primary Examiner*—Scott Kastler
*Attorney, Agent, or Firm*—William R. Hinds

[57] ABSTRACT

A method and apparatus are described for controlling the rate of pouring of molten metal. Examples are given of pouring metal onto a steel strip to form a coating having a uniform controlled thickness thereon. The method comprises the use of an intermediate holding dish having pouring means in the form of a generally vertical slot. The metal head presented to the slot is variable in response to signals from sensors measuring, for example, total strip thickness and the metal level within the holding dish. Signals from the sensors are also used to generate control signals to vary the rate of pouring from a holding furnace into the dish.

4 Claims, 4 Drawing Sheets

METAL POURING SYSTEM

This is a division of application Ser. No. 527,309 filed May 23, 1990.

The present invention relates to a method and apparatus for the control of the rate of pouring of molten metal.

In many casting applications such as, for example, in continuous casting where molten metal is poured into a die for subsequent solidification or in strip casting applications, where the metal is poured onto a backing strip to form a lining thereon, it is highly desirable to be able to exert close control over either the head of metal in the die tundish or on the thickness of metal in the lining.

Where a lining is cast onto a backing strip it is common practice to employ two melting furnaces from which the molten metal is directly poured, usually via a launder, onto the backing strip. Whilst one furnace is being used to pour the metal the other is generally melting a fresh charge ready to be used as the first furnace becomes exhausted. When pouring directly from a melting furnace, it is very difficult to precisely control the flow rate of the molten metal since the bulk is large and the geometry of the pouring lip with regard to the metal surface is constantly changing. It is also difficult to maintain a constant, continuous flow when changing over furnaces; flow rates are increased to compensate for inaccuracies.

In applications where relatively high value metal, such as copper based alloys, for example, are being cast onto a steel backing strip it is essential that too thin a lining is avoided. If the lined strip has to be scrapped it has very little value because of the presence of the steel bonded thereto and the difficulty of separating the copper from it. For this reason it is usual to err on the side of a generous machining allowance for the alloy lining. However, this also has disadvantages since large quantities of alloy swarf have to be recycled with attendant losses on remelting due to oxidation.

It is an object of the present invention to provide a method for more accurate control of the rate of flow of molten metal than is obtainable by pouring from a conventional melting furnace.

According to a first aspect of the present invention a method for the control of the rate of flow of molten metal comprises the steps of measuring by first sensor means the thickness of metal poured onto a moving strip, comparing the measured thickness with a desired thickness stored in computer memory and control means, measuring the level of molten metal in intermediate holding dish means by second sensor means which is also linked to computer memory and control means, increasing or decreasing, as appropriate the rate of pour from holding furnace melting means to the intermediate holding dish means by signals from the computer control means to furnace pour rate control means in order to minimise the difference between the actual measured metal thickness of the strip and the desired thickness by adjustment of the molten metal level in the intermediate holding dish relative to pouring means in the holding dish.

Preferably the intermediate holding dish means is maintained stationary and consists of a dish which has a relatively large surface area to volume ratio so that minor, short term fluctuations in metal flow from the holding furnace have a negligible effect on the level of molten metal in the dish.

The control of metal flow from the intermediate holding dish via the pouring means is effected by varying the head of metal presented to and passing through a generally vertical pouring slot whose width is relatively small compared to its height. This has been found to provide much greater control of the rate of pouring than with known methods of pouring such as, for example, teeming over a relatively wide lip on the edge of a crucible.

The intermediate holding dish may itself be moveable and used as a rate of pouring control by varying the apparent metal head presented to the pouring slot. This is effected by maintaining a substantially constant metal level and varying the height of the pouring slot in the dish relative to the constant metal level by tilting of the dish. In this way the pouring rate onto the strip, for example, may be increased or decreased. The constant metal level is maintained by varying the rate of pour from the holding furnace in response to signals from the second sensor means via the computer control means.

Both the holding dish and holding furnace may be controlled by servo motors or by hydraulic means, for example.

Preferably the first and second sensor means may be laser gauge probes. Where the parameter being measured is the total thickness of a strip on which metal is being cast, two interconnected probes may be used.

According to a second aspect of the present invention, apparatus for the control of the rate of flow of molten metal onto a moving strip, comprises first sensor means for measuring the thickness of metal poured onto the strip, the first sensor means being linked to computer memory and control means for comparing the actual thickness of metal on the strip with a desired thickness stored in the computer memory to be achieved, second sensor means linked to the computer memory and control means to measure the level of molten metal in intermediate holding dish means having pouring means, furnace melting means having servo control means to vary the rate of pour from the furnace to the intermediate holding dish means, the rate of pour from the furnace melting means being responsive to signals to the servo control means from the computer control means in order to minimize the difference between the actual measured thickness of the strip and the desired thickness by adjustment of the metal level in the intermediate holding dish means relative to the pouring means in the holding dish.

BRIEF DESCRIPTION OF THE DRAWINGS

In order that the present invention may be more fully understood examples will now be described by way of illustration with reference to the accompanying drawings of which;

Referring now to FIGS. 1 and 3 and where a preheated steel strip 10 having a solid coating of leaded bronze 12 cast thereon is passing from right to left. A melting and holding furnace 14 containing molten metal 16 is pivoted by a servo motor 18 about an axis 20 adjacent a pouring lip 22. The molten metal 16 is poured down a launder 24 into a stationary, intermediate holding dish 26. The molten metal flows out of the dish 26 via a slot 28 (see FIGS. 3 and 4) onto a spreader 30 and finally onto the strip 10 where it rapidly solidifies with the aid of quench sprays 32 as the coating 12. The thickness of the coated strip is measured by first sensor means which in this case comprises a pair of interlinked laser gauge probes 34. The probes 34 are linked 36 to computer memory and control means 38 which are also adapted to transmit signals 40 to second sensor means, which comprises a laser gauge probe 42, and to receive signals 44 therefrom. The computer control means 38 also transmits control signals 46 to a servo motor 18. The launder 24, dish 26 and spreader 30 are all enclosed within a heating chamber 48 which maintains a suitable temperature and protective atmosphere to prevent premature solidification and oxidation of the molten metal 16.

Figure 1:
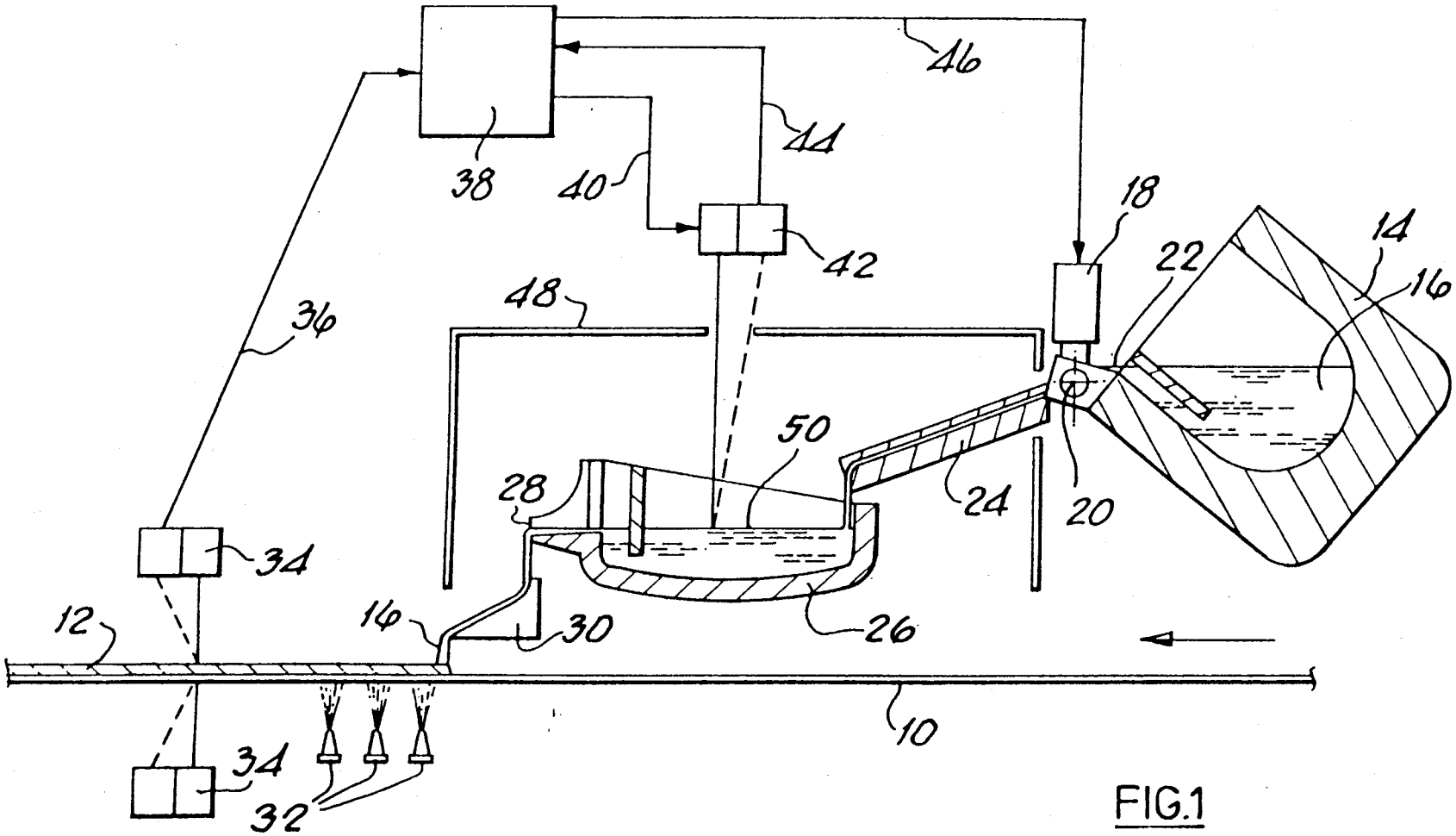
FIG. 1 shows a schematic view of a first embodiment of apparatus for carrying out the method of the present invention.

In operation molten metal is poured onto the strip 10 and solidifies as the coating 12; the thickness of the lining is calculated from the signals 36 produced by the two linked laser probes 34 and transmitted to the computer memory and control means 38. If the coating thickness is correct within preset tolerance limits the molten metal level 50 within the dish 26 is maintained at a constant level by the metal flow from the furnace 14. If, however, the thickness of the coating 12 is too thick as measured by the probes 34, signals 36 are transmitted to the computer memory and control means 38 which then instructs the laser probe 42 via signals 40 to set a new, lower reference level 50 in the dish 26. Since the instantaneous level of the metal at this point is too high relative to the new lower level demanded by the sensor 42 signals 44 are transmitted to the computer control means 38 which then instructs the servo motor 18 via signals 46 to reduce the metal flow from the furnace 14. Metal flow down the launder 24 is reduced and consequently the metal level 50 in the dish 26 falls until it reaches the new level demanded by the sensor 42. At this point signals 44 are sent to the control means 38 which instructs the servo motor 18 to maintain the rate of pour from furnace 14 to maintain the new metal level 50. The laser probes 34 continuously measure the strip, and thus the coating thickness 12 and, by the mechanism described above, seek to minimize the difference between the measured thickness of the strip and the desired thickness stored in the computer memory and control means 38. Similarly, if the thickness of the strip measured by the probes 34 is too low the computer memory and control means instructs the laser probe 42 to set a new, higher metal level in the dish 26. Since the instantaneous metal level is now too low, signals 46 are sent to the servo motor 18 to increase the rate of pour from the furnace 14 until the new, higher metal level is achieved.

Figure 5:
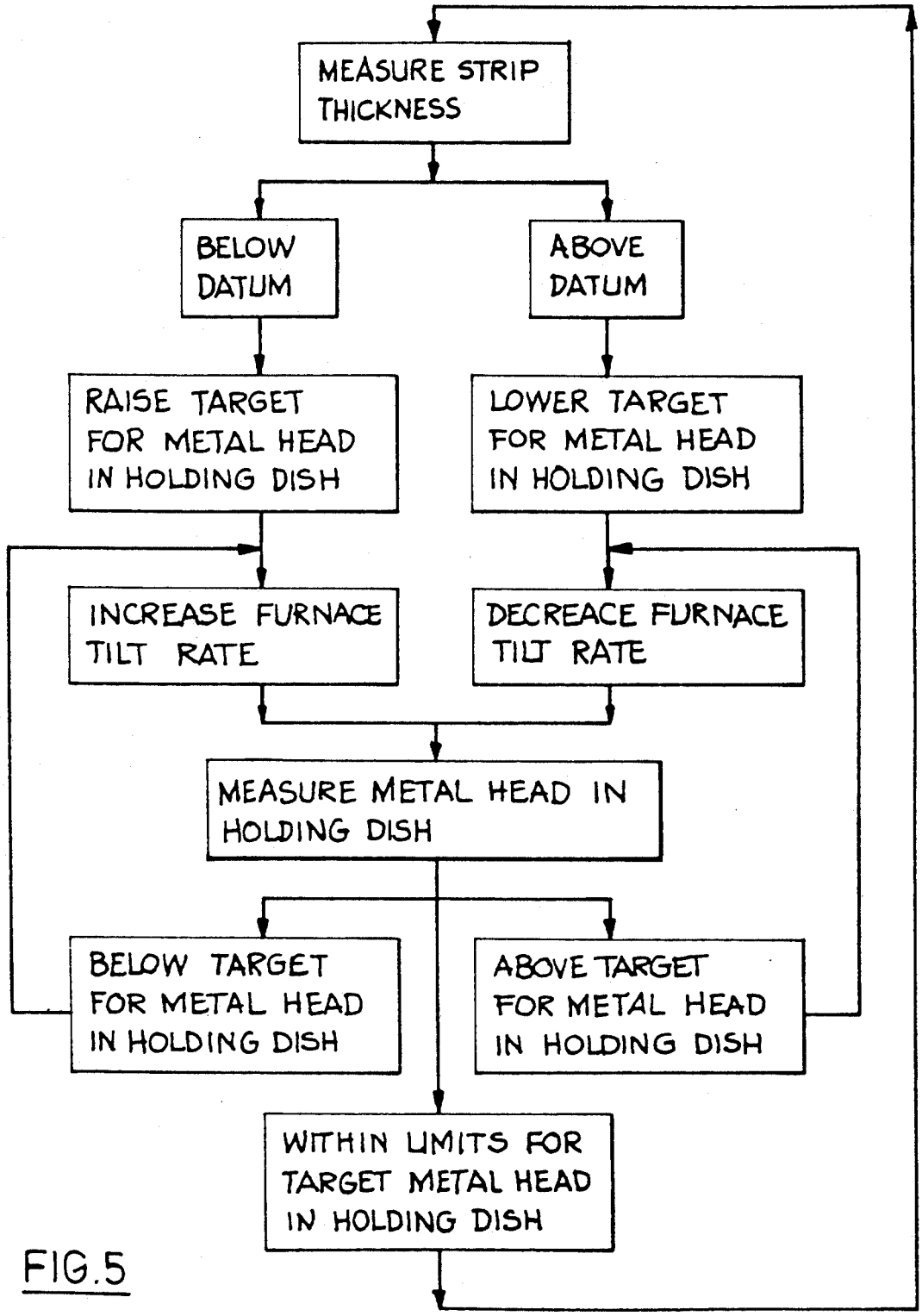
FIG. 5 which shows an operational logic flow chart for a control system for the apparatus shown in FIG. 1.

The above description of the operation of the control system is shown in logic flow chart form in FIG. 5.

Figure 2:
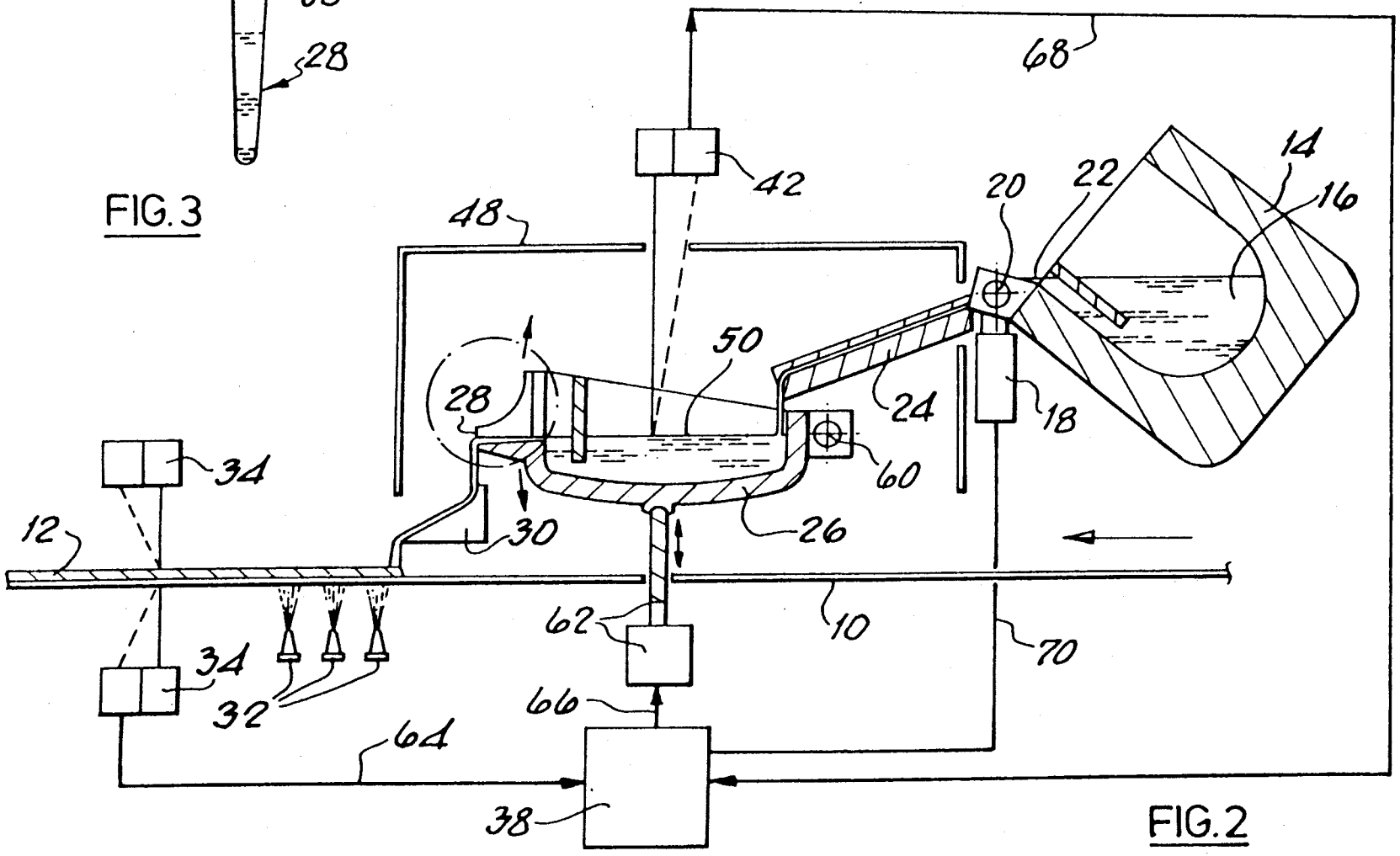
FIG. 2 shows a schematic view of a second embodiment of apparatus for carrying out the method of the present invention.
Figure 3:
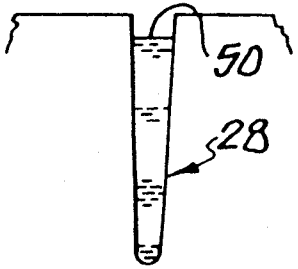
FIG. 3 shows an enlarged view of the pouring slot of the holding dishes of FIGS. 1 and 2.

An alternative control system is shown in FIGS. 2 and 3 and where the same features have common reference numerals. In this system the laser sensor 42 is set to detect a constant metal level, the rate of pouring from the dish 26 being varied by pivoting the dish 26 about an axis 60 by means of a servo controlled height support 62. The effect of pivoting the dish is to vary the head of metal presented to the pouring slot 28 (See FIG. 3), bearing in mind that the metal level 50 is maintained constant irrespective of the vertical position of the dish 26.

In operation, this system functions as described in the ensuing explanation. If the laser sensors 34 detect that the coating 12 is too thick a signal 64 is sent to the computer memory and control means 38 which then signals 66 the servo controlled support 62 to raise the dish 26 in order to reduce the head of metal presented to the pouring slot 28. The laser sensor 42 is pre-set to detect a constant metal level 50, irrespective of the vertical position of the dish 26. As the dish 26 is raised the metal level 50 is also consequently raised; the sensor 42, detecting an increase in metal level 50 signals 68 the computer memory and control means 38 to reduce the rate of pouring from the holding furnace 14 into the dish 26. This is effected by the computer 38 signalling 70 the servo control motor 18 of the pouring furnace to reduce the rate of pour. The rate of pour into the dish 26 is reduced until the metal level 50 falls to the pre-set, constant level the sensor 42 is set to detect. At this point the rate of pour from the furnace 14 is maintained. The thickness of the strip being measured by the sensors 34 is maintained within pre-set tolerances and the system acts to minimize the difference between the thickness measured by the sensors 34 and the desired thickness stored in the memory of the computer memory and control means 38.

In the case where the strip being measured by the sensors 34 is too thin, signals 66 instruct the servo controlled support 62 to lower the dish 26. This causes an increased head of metal to be presented to the pouring slot 28. The sensor 42 detects a fall in the metal level and the signal 68 to the computer 38 causes a signal 70 to be sent to the servo control 18 to increase the pouring rate from the furnace 14 into the dish 26 to increase the rate of pour until the desired constant metal level 50 is restored.

Figure 4:
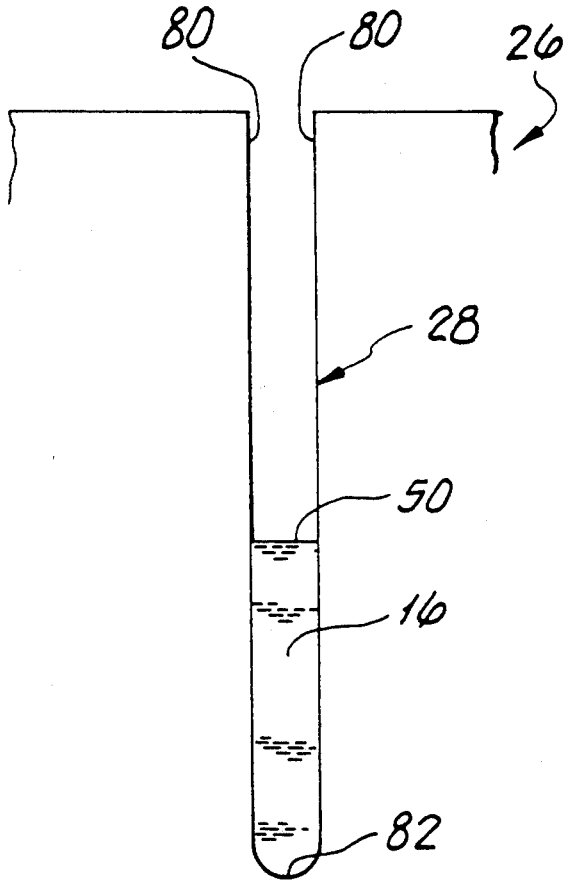
FIG. 4 shows a modified pouring slot to that shown in FIG. 3.

FIG. 4 shows a modified pouring slot 28 to that of FIG. 3. In this embodiment the slot has substantially parallel sides 80. The effect of this is to produce a substantially linear variation in metal flow rate from the holding dish 26 as the metal level 50 is varied with respect to the slot. In one example where a leaded-bronze or copper-lead alloy is being poured a slot width of 8 mm provides a variation in potential flow rate from less than 500 kg/hour to over 1200 kg/hour depending upon the metal head height 50 relative to the bottom lip 82 of the slot 28.

I claim:

1. Apparatus for the control of the rate of flow of molten metal onto a moving strip, the apparatus comprising first sensor means for measuring the thickness of metal poured onto the strip, the first sensor means being linked to computer memory and control means for comparing the actual thickness of metal on the strip with a desired thickness stored in the computer memory to be achieved, second sensor means linked to the computer memory and control means to measure the level of molten metal in intermediate holding dish means having pouring means, furnace melting means having servo control means to vary the rate of pour from the furnace to the intermediate holding dish means, the rate of pour from the furnace melting means being responsive to signals to said servo control means from the computer control means in order to minimize the difference between the actual measured thickness of the strip and the desired thickness by adjustment of the metal level in the intermediate holding dish means relative to said pouring means in the holding dish.

2. Apparatus according to claim 1 wherein said first and second sensor means are laser gauge probes.

3. Apparatus according to claim 1. wherein said pouring means in said intermediate holding dish means is in the form of a generally vertical slot.

4. Apparatus according to claim 3 wherein said slot has substantially parallel sides.

* * * * *